US007845884B2

(12) United States Patent
Warren

(10) Patent No.: US 7,845,884 B2
(45) Date of Patent: Dec. 7, 2010

(54) RESIN INSERTION DEVICE AND METHODS OF INSERTING RESIN

(75) Inventor: Ben Warren, GlenRock, WY (US)

(73) Assignee: New Era Petroleum, LLC., Sheridan, WY (US)

( * ) Notice: Subject to any disclaimer, the term of this patent is extended or adjusted under 35 U.S.C. 154(b) by 304 days.

(21) Appl. No.: 12/119,360

(22) Filed: May 12, 2008

(65) Prior Publication Data

US 2009/0279961 A1 Nov. 12, 2009

(51) Int. Cl.
*E02D 21/00* (2006.01)

(52) U.S. Cl. ..... 405/259.5; 405/259.6; 405/303; 227/147

(58) Field of Classification Search ... 405/259.1–259.6, 405/303; 227/147; 173/206
See application file for complete search history.

(56) References Cited

U.S. PATENT DOCUMENTS 3,023,413 A * 3/1962 Fischer et al. ..... 227/5
4,398,850 A * 8/1983 Talvensaari ..... 405/259.6
4,627,563 A * 12/1986 Meyer ..... 227/130
5,485,946 A * 1/1996 Jankel ..... 227/8
5,951,208 A * 9/1999 Wilson et al. ..... 405/259.6
6,698,529 B2 * 3/2004 Coombs et al. ..... 173/4
6,793,445 B1 * 9/2004 Charlton et al. ..... 405/259.5

* cited by examiner

*Primary Examiner*—David J Bagnell
*Assistant Examiner*—Benjamin Fiorello
(74) *Attorney, Agent, or Firm*—Wells St. John P.S.

(57) ABSTRACT

A resin insertion device includes a barrel, a piston within the barrel, and a triggering mechanism. The triggering mechanism includes an air outlet, an air inlet, a venturi tube and at least one trigger piston. A resin insertion device includes a barrel having a collar disposed at a first end and a piston disposed slidably within the barrel. A triggering mechanism is disposed at a second end. A first position of the trigger prevents airflow through an air inlet, a second position allows air through the inlet and an outlet, and a third position prevents airflow through the outlet. A method of inserting resin into a bore hole includes providing an insertion device including a barrel, and a triggering mechanism. The method includes depressing a trigger from a first to a second position, placing at least one resin cartridge within the barrel, and further depressing the trigger.

12 Claims, 9 Drawing Sheets

RESIN INSERTION DEVICE AND METHODS OF INSERTING RESIN

TECHNICAL FIELD

The invention pertains to resin insertion devices and methods of inserting resin into a bore hole.

BACKGROUND OF THE INVENTION

The roof and walls of mines and other underground structures are typically reinforced utilizing various strengthening and support techniques. One such support and reinforcement technique is to drill bore holes into the rock and insert resin cartridges into the bore holes. The resin cartridges typically contain a resin and an activator which are contained within a casing and separated from one another. Multiple cartridges are often utilized for each reinforcement bore hole.

Once sufficient resin cartridges have been inserted into the bore hole, a long metal bolt is forced into the hole and through the resin cartridges while being rotated. Such penetrates the cartridges and mixes the resin and activator initiating the solidification process about the bolt. Upon curing of the resin the retained bolt/resin mixture provides reinforcement to the surrounding geologic structure within which it's received. The cured resin epoxy can be at least eight times stronger than rock.

A number of techniques exist by which resin cassettes (also known as sausages) are inserted into bore holes. One method is to insert each cassette manually and force the cassettes into the bore hole utilizing a bar or pipe. Such technique can be awkward and unsafe. The mechanical resin cartridge inserters available can be overly long. Both the water powered and air powered inserters can be difficult to align with the bore hole. Additionally, water powered inserters are limited to wet drilling operations. It is desirable to develop alternative resin cartridge inserters and methods of inserting resin cartridges.

SUMMARY OF THE INVENTION

In one aspect the invention pertains to a resin insertion device including a barrel, a piston disposed slidably within the barrel, and a triggering mechanism. The triggering mechanism includes an air outlet, an air inlet, a venturi tube and at least one trigger piston.

In one aspect the invention includes a resin insertion device. The device includes a barrel having a first end and a second end. A collar is disposed at the first end of the barrel and a piston is disposed slidably within the barrel. A triggering mechanism is disposed at the second end of the barrel. The device further includes an air inlet into the triggering mechanism, an air outlet from the triggering mechanism, and a trigger having at least three positions. A first position of the trigger prevents airflow through the air inlet, a second position allows air through the inlet and the outlet, and a third position prevents airflow through the outlet.

In one aspect the invention includes a method of inserting resin into a bore hole. The method includes providing an insertion device including a barrel having a first and second end, a collar disposed at the first end of the barrel, a piston disposed slidably within the barrel, and a triggering mechanism disposed at the second end of the barrel. The device further includes an air inlet into the triggering mechanism, an air outlet from the triggering mechanism and a trigger having at least three positions. The at least three positions include a first position preventing airflow through the inlet, a second position allowing air through the inlet and the outlet, and a third position preventing airflow through the outlet. The method includes depressing the trigger from the first position to the second position, placing at least one resin cartridge within the barrel through the first end, and further depressing the trigger to the third position.

BRIEF DESCRIPTION OF THE DRAWINGS

Preferred embodiments of the invention are described below with reference to the following accompanying drawings.

FIG. 10 is a cross-sectional side view of the component shown in FIG. 9.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
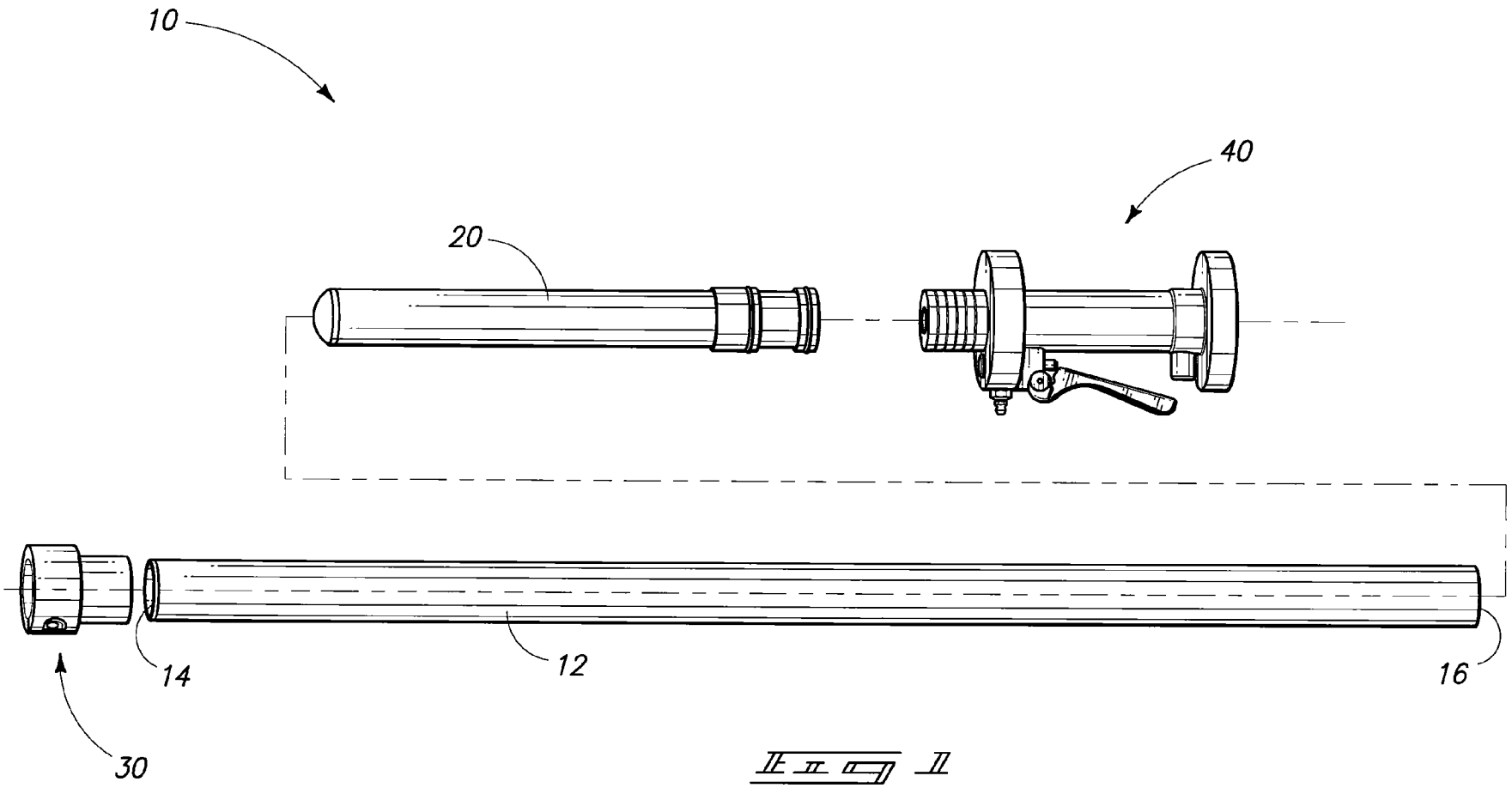
FIG. 1 is an exploded side view of a device in accordance with one aspect of the invention.

Embodiments of the invention include devices and methodology for insertion of resin cartridges into bore holes. The devices and methodology are described generally with reference to FIGS. 1-10. Referring initially to FIG. 1, such depicts an exemplary device in accordance with one aspect of the invention. A device 10 is shown comprising a barrel 12 having a first end 14 and a second end 16. As depicted, barrel 12 can be cylindrical such that a cylindrical piston 20 can be inserted into the second end of the barrel. Device 10 includes a collar portion disposed at the first end of the barrel 12. Device 10 further comprises a triggering mechanism 40 disposed at the second end of the barrel.

Figures 2, 3:
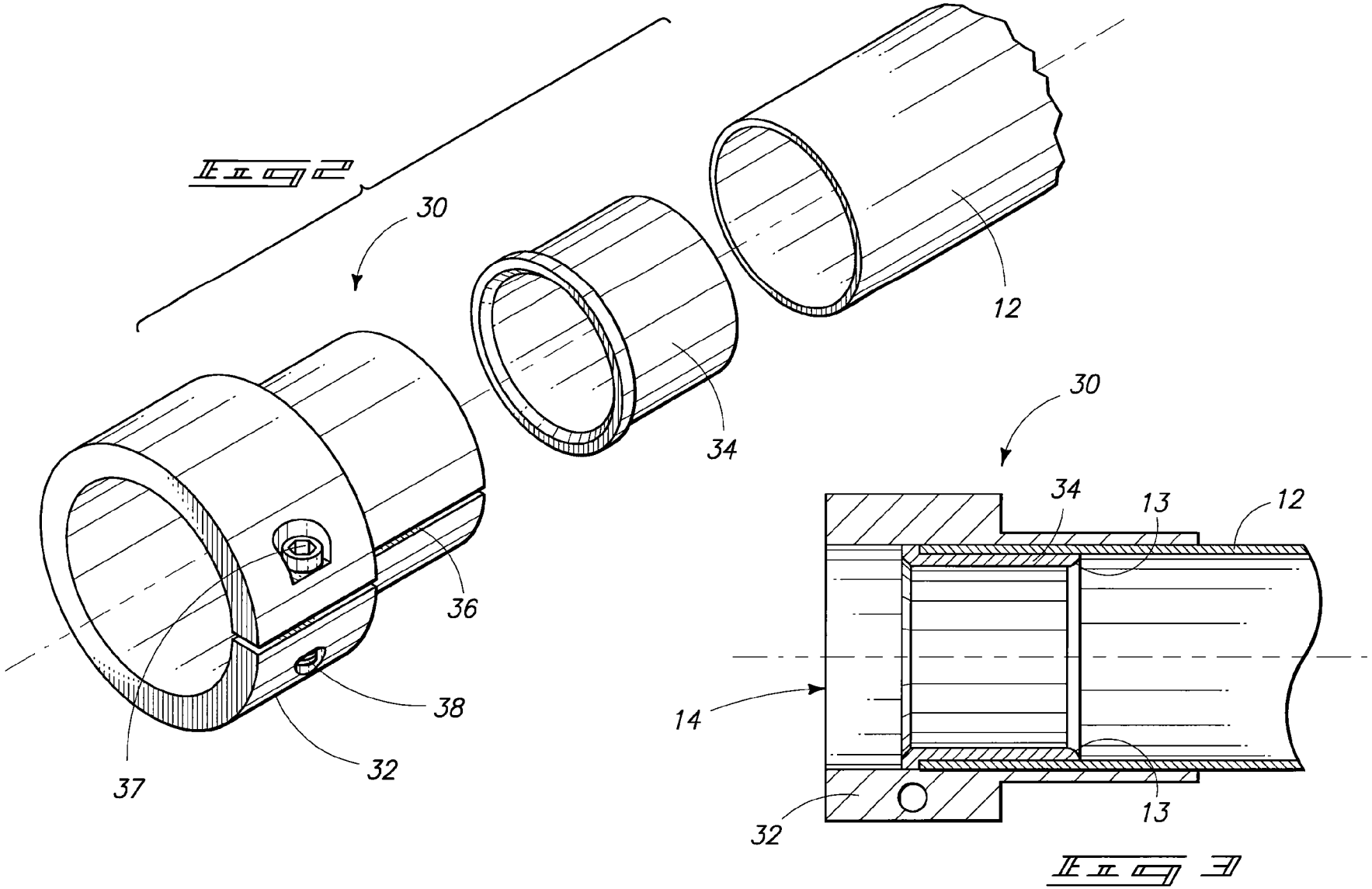
FIG. 2 is an exploded side view of a portion of a device in accordance with one aspect of the invention.
FIG. 3 is a cross-sectional side view of a portion of a device in accordance with one aspect of the invention.

Referring to FIG. 2, such shows an exploded view of collar 30. As depicted, collar 30 can comprise two portions, an inner portion 34 and an outer portion 32. Outer portion 32 can have a slit 36 running full length of the body. Outer portion 32 can further be drilled to receive a bolt 37 through the drilled opening 38 for tightening collar 30 onto the first end of the barrel.

Referring to FIG. 3, a cross-sectional fragmentary view of a portion of device 10 having collar 30 mounted on barrel 12 is depicted. Inner portion 34 of collar 30 is inserted within barrel 12. Such insertion forms shoulders 13 within the barrel. This shoulder retains the piston from exiting the barrel upon operation of device 10. Outer portion 32 fits over barrel 12 as shown and tightening of bolt 37 (FIG. 2) with drilled portion 38 of outer portion 32 tightens the outer portion thereby retaining inner and outer portion of the collar on first end 14 of barrel 12.

Figure 4:
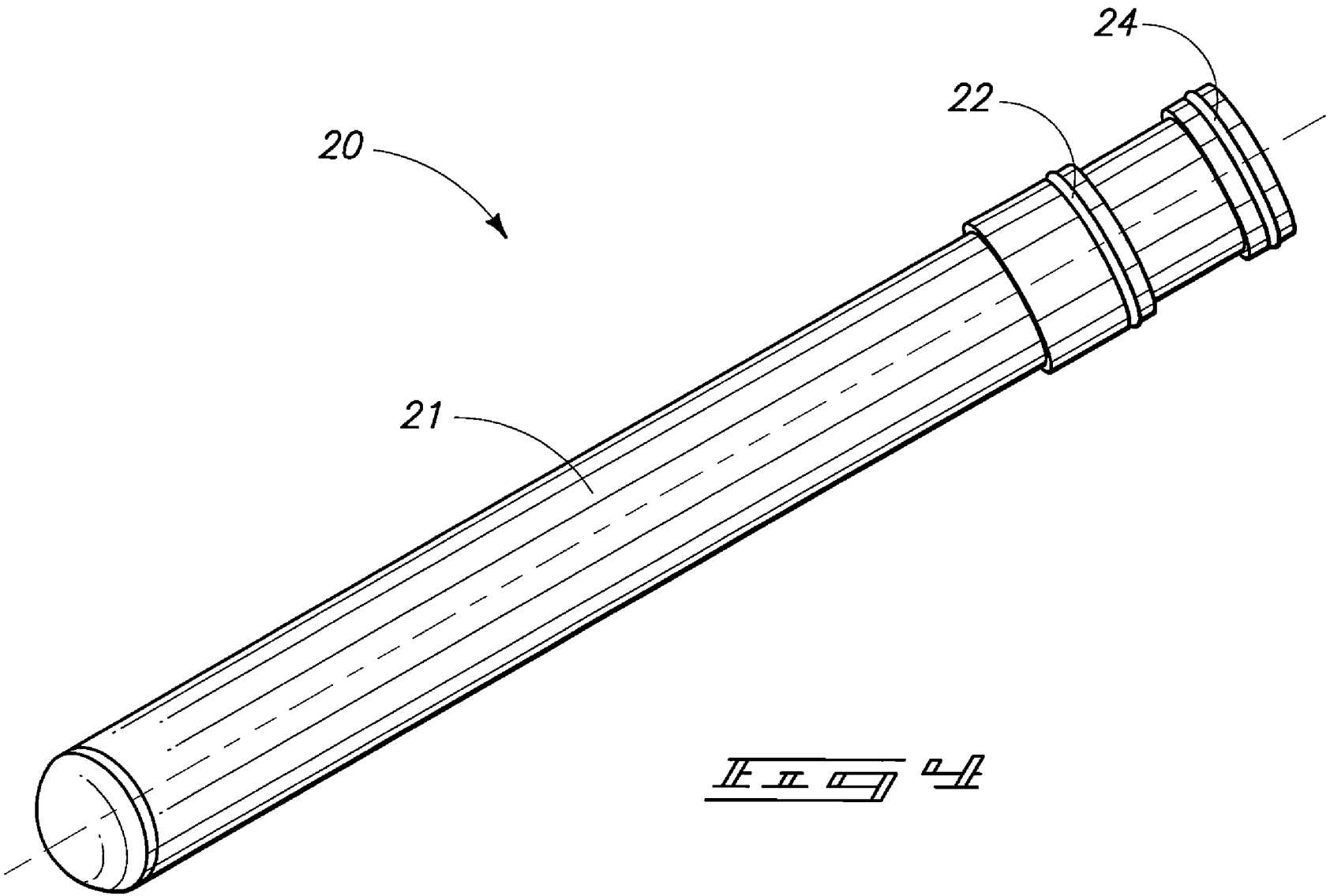
FIG. 4 is a side view of a component of a device in accordance with one aspect of the invention.

Referring to FIG. 4, piston 20 can be slidably inserted into the second end of the device barrel. Piston 20 can have a first portion 21 with a first diameter and a second portion 23 with a second larger diameter. The piston has at least one O-ring 22 and preferably at least two O-rings 22, 24. Such O-rings allow piston 20 to be sealable against the inner walls of the barrel. Preferably, piston 20 is sealed airtight relative to the walls of the barrel. In operation of the device, piston 20 slides from the rear (second end) of the barrel towards the forward end (first end) of the barrel. The smaller diameter portion 21 of the piston is allowed to extend through the first end of the barrel. However, shoulder 13 created by inner portion of the collar as shown in FIG. 3 halts passage of the piston at the larger diameter portion 23. Accordingly, piston 20 is retained within the barrel for subsequent operation.

Figure 5:
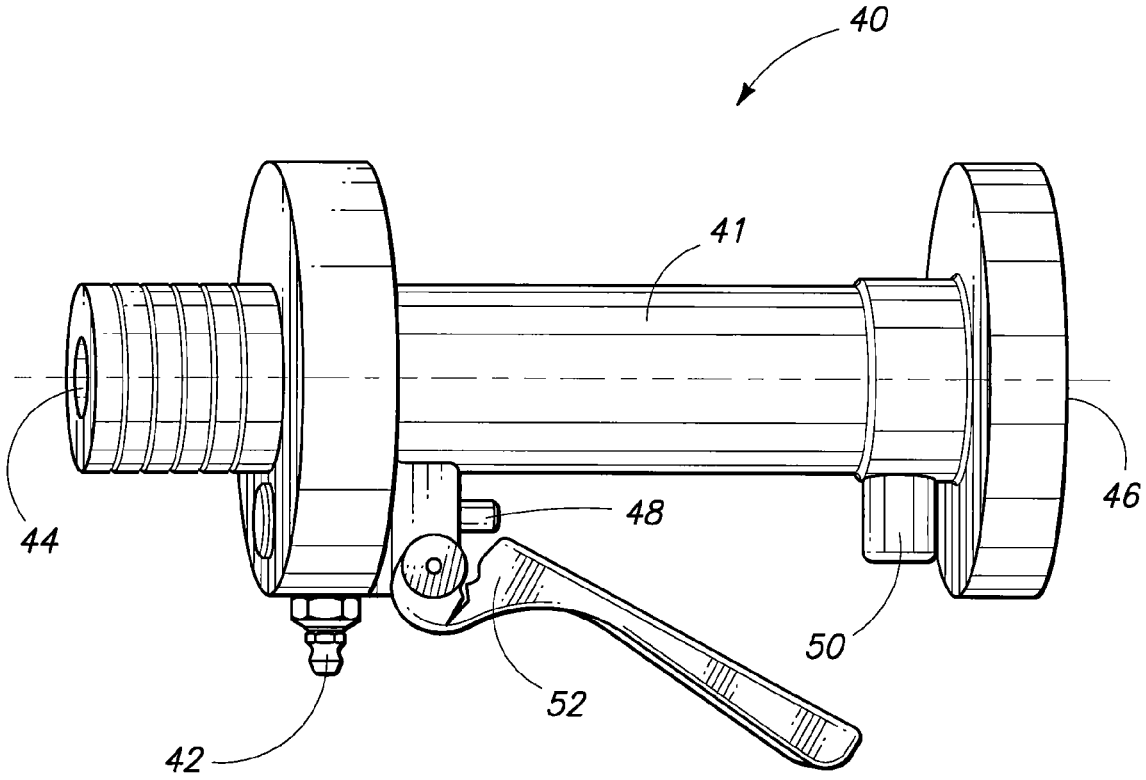
FIG. 5 is a side view of a component of a device shown in a first position configuration in accordance with one aspect of the invention.
Figure 6:
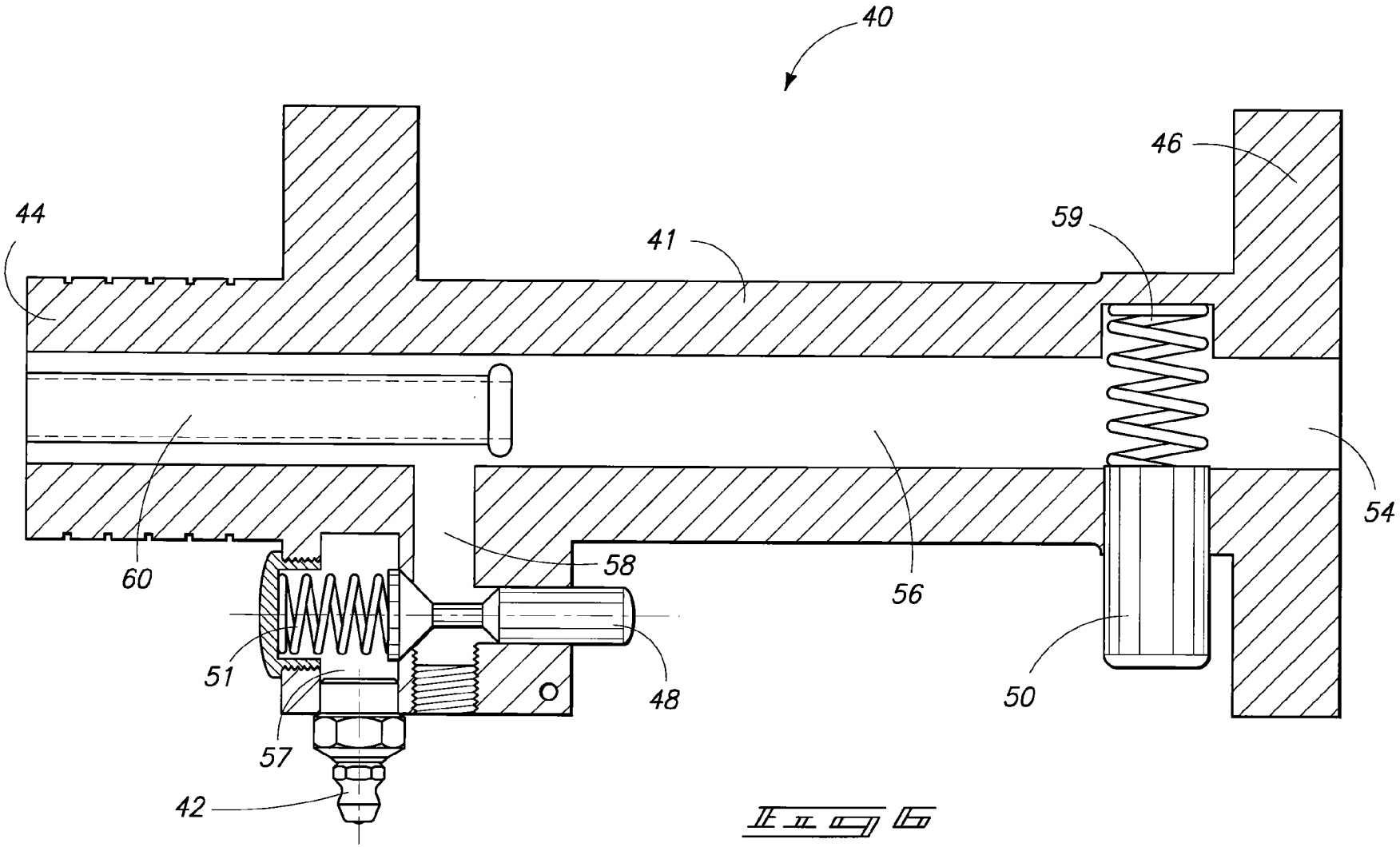
FIG. 6 is a cross-sectional side view of the component of the device shown in FIG. 5.

FIGS. 5-10 depict the triggering mechanism at various positions of a trigger. Referring to FIG. 5 such shows an external side view of triggering mechanism 40 with a trigger 52 shown in an initial position. Trigger 52 can be in one of at least three differing positions. FIG. 6 shows an internal cross-sectional view of the triggering mechanism when the trigger is in the initial or "first" position as depicted in FIG. 5. In FIG. 6 the trigger is not shown for ease of depiction. Referring to FIG. 5, triggering mechanism 40 has a body portion 41 with a first end 44 configured to connect with second end of the barrel. Body 41 has an opposing second end 46, as shown. Triggering mechanism 40 also includes an air inlet 42 comprising an air fitting for adapting to an air source (not shown). Mechanism 40 further includes a first trigger piston 48 with a first spring 51 and a second trigger piston 50 with a second spring 59. Trigger 52 is configured to selectively depress trigger piston 48 and trigger piston 50.

Referring to FIG. 6, a main air passageway 56 runs longitudinally through the triggering mechanism. A venturi tube 60 is disposed within the air passageway proximate the first end of the triggering mechanism. The venturi tube can be mounted within the air passageway of the triggering mechanism by, for example, press fitting. The air inlet has a passageway 57 extending from the external fixture to first trigger piston 48. The inlet further includes a second passageway 58 from the first piston trigger to the main air passageway 56. When trigger 52 is in the first position, trigger piston 48 is not depressed and air is blocked from entering air passageway 58. Air passageway 56 has an air outlet 54 disposed at second end 46 of the triggering mechanism.

Figure 7:
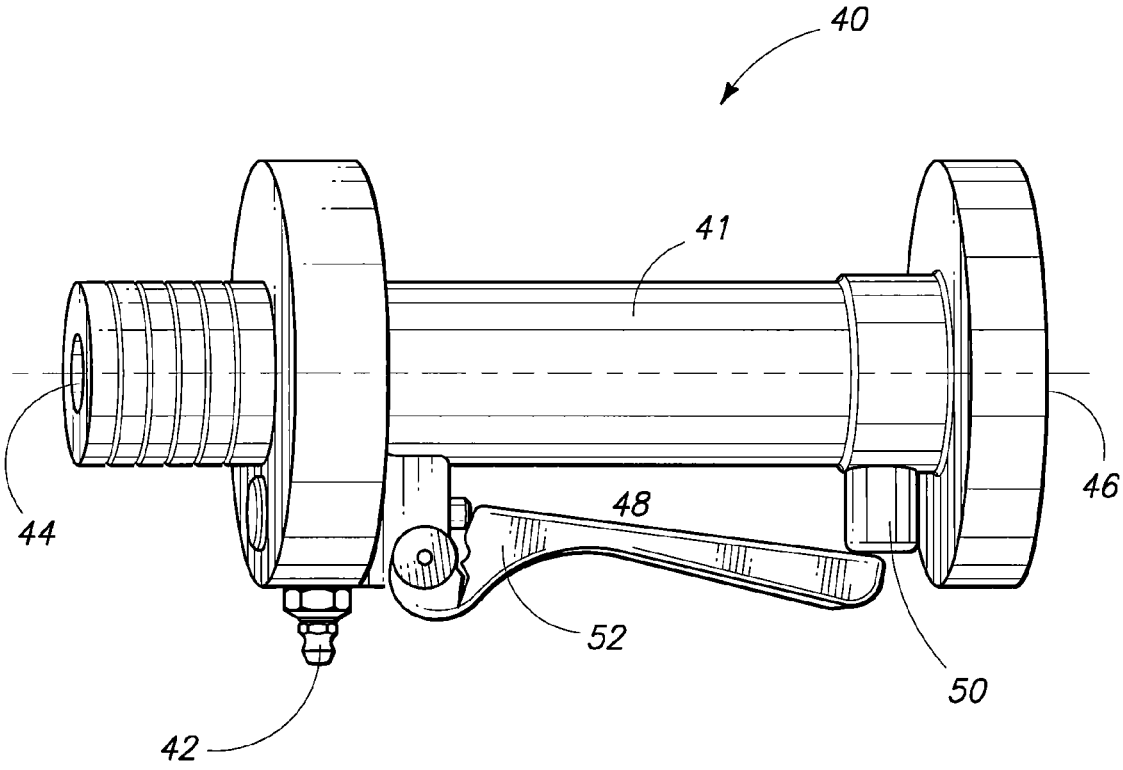
FIG. 7 is a side view of a component of a device shown in a second position configuration in accordance with the invention.
Figure 8:
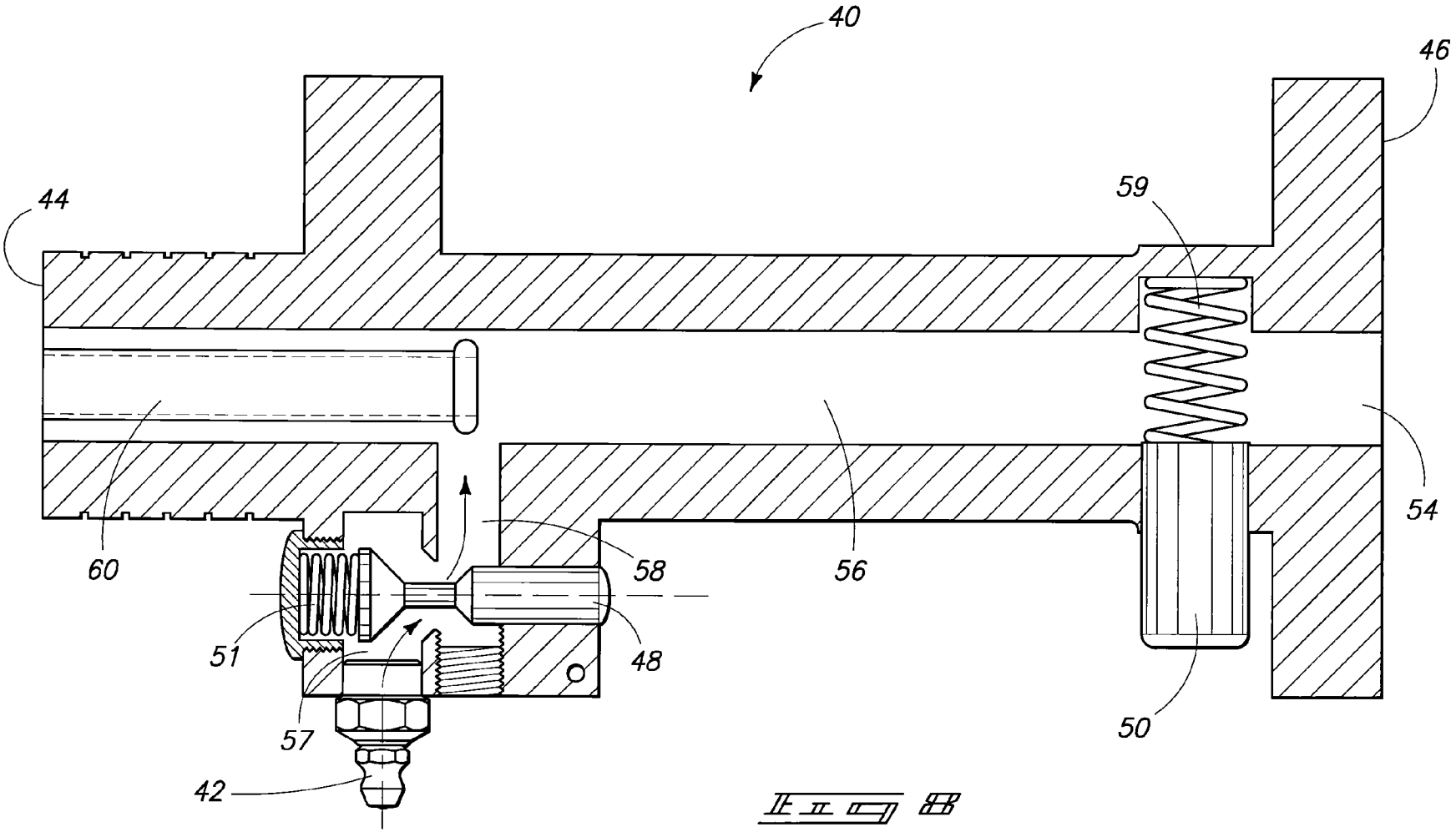
FIG. 8 is a cross-sectional side view of the component shown in FIG. 7.

Referring to FIGS. 7 and 8, such show triggering mechanism 40 where trigger 52 is in a second position. As shown in FIG. 7, trigger 52 is positioned such that trigger piston 48 is depressed while trigger piston 50 is in the non-depressed position. Referring to FIG. 8, trigger piston 48 is shown in the depressed position with spring 51 compressed. This depression allows air passage through passage 57 and passage 58. In this state, air is allowed to freely flow out air outlet 54. Additionally, as air passes around venturi tube 60 a venturi effect is created pulling air back toward outlet 54. This effect causes a vacuum within barrel 12 which draws piston 20 within the barrel back toward the triggering mechanism.

Figure 9:
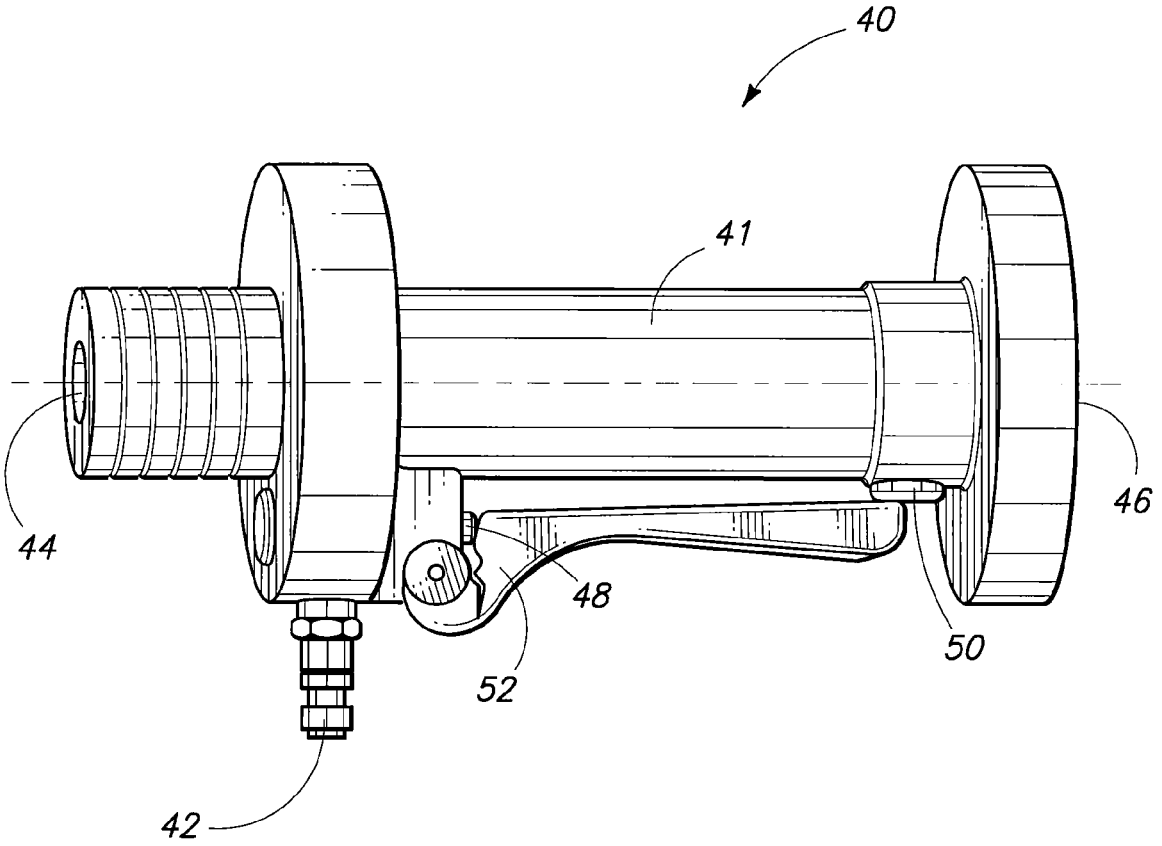
FIG. 9 is a side view of a component of a device shown in a third position configuration in accordance with one aspect of the invention.
Figure 11:
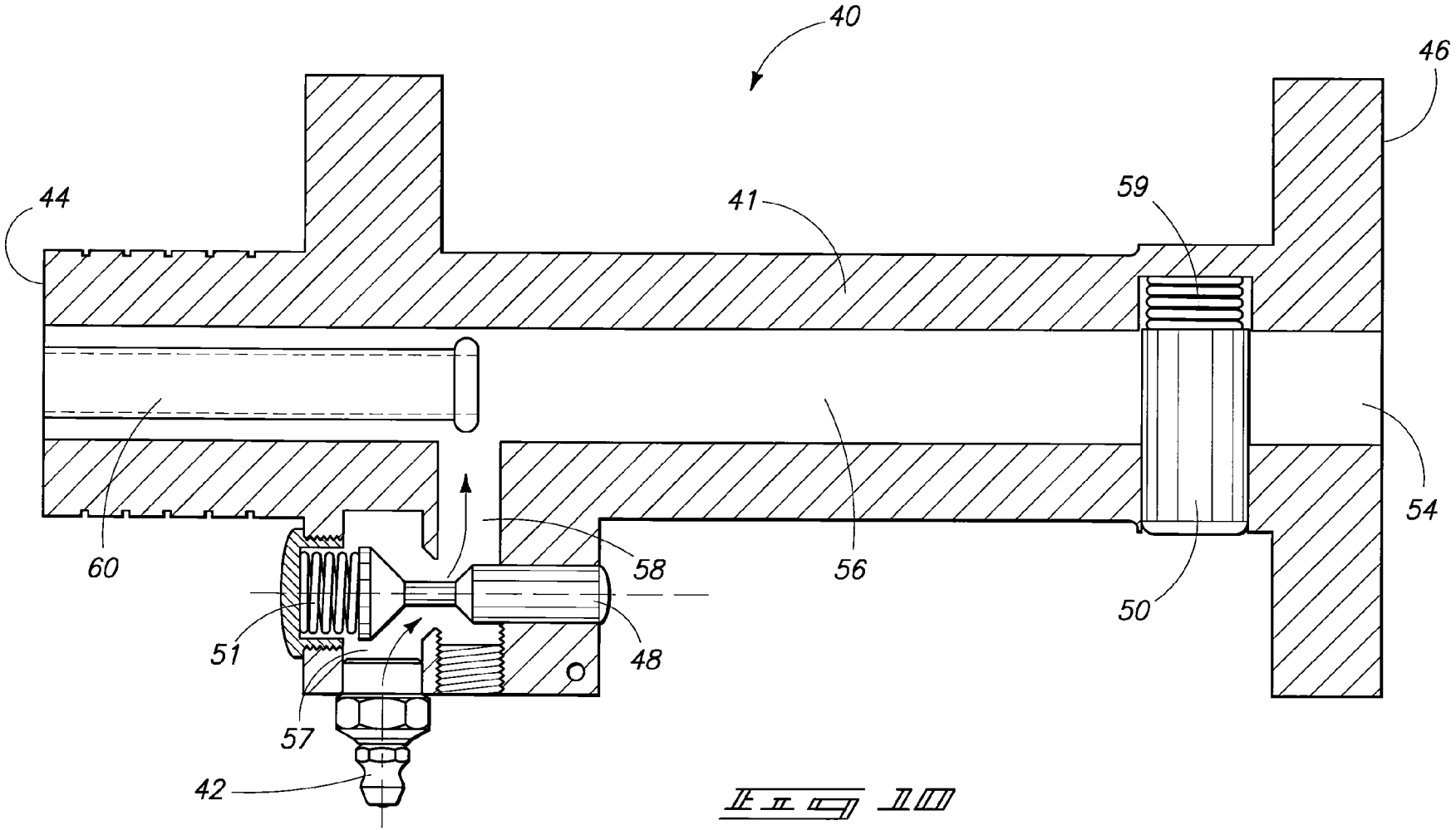

FIGS. 9 and 10 depict the triggering mechanism having the trigger in a third position. Referring to FIG. 9, trigger 52 is positioned such that first piston trigger 48 is depressed and second trigger piston 50 is also depressed. As shown in FIG. 10, with trigger piston 48 depressed, air is allowed to flow through inlet passages 57 and 58. However, with second trigger piston 50 depressed, air is no longer allowed to escape through outlet 54. Thus, air is forced passed venturi tube 60 to exit the triggering mechanism via the barrel of the device. This activation causes the piston 20 to be forced forward through the barrel of the device until it reaches the shoulder created by the collar (discussed above).

In operation, methodology of the invention utilizes this three position triggering mechanism to expel resin cartridges from the device barrel into a bore hole. The device can be prepared for operation by attaching the air inlet fitting to an air source which can be performed, for example, with the trigger in position one. In this position air flow is prevented from flowing through the air inlet. The trigger can then be placed in a second position such as depicted in FIG. 7. This position allows air to flow through the inlet and also through the outlet creating a venturi effect and drawing the piston back through the barrel toward the triggering mechanism. At least one resin cartridge can then be loaded into the barrel through the first end. Typically, two cartridges will be utilized per operation of the device.

Once the cartridges have been loaded into the barrel, the device can be positioned to align the barrel with the bore hole. The trigger can then be positioned into a third position which allows air through the inlet but prevents airflow through the outlet. Such trigger positioning thereby forces air into the barrel forcing the piston forward and expelling the resin cartridges into the bore hole. The leading end of the piston can be partially expelled from the first end of the barrel.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A resin insertion device comprising:

a barrel having a first end and a second end;

a collar disposed at a first end of the barrel;

a piston disposed slidably within the barrel;

a triggering mechanism disposed at a second end of the barrel;

an air inlet into the triggering mechanism;

an air outlet from the triggering mechanism; and a trigger having at least three positions, a first position preventing airflow through the air inlet, a second position allowing air through the inlet and the outlet, and a third position preventing airflow through the outlet.

2. The device of claim 1 wherein the collar has a first portion disposed internally relative to the barrel and a second portion disposed externally to the barrel.

3. The device of claim 2 wherein the first portion of the collar forms a shoulder within the barrel and wherein the shoulder halts forward motion of the piston.

4. The device of claim 1 wherein depressing the trigger to the second position initiates a backward motion of the piston toward the triggering mechanism.

5. The device of claim 1 wherein depressing the trigger to the third position initiates a forward motion of the piston toward the first end of the barrel.

6. The device of claim 1 wherein the piston comprises at least one o-ring and wherein the piston slides sealably within the barrel.

7. The device of claim 1 wherein the air outlet of the triggering mechanism is disposed opposing the second end of the barrel.

8. A method of inserting resin into a bore hole, comprising:

providing an insertion device comprising:

a barrel having a first end and a second end;

a collar disposed at a first end of the barrel;

a piston disposed slidably within the barrel;

a triggering mechanism disposed at a second end of the barrel;

an air inlet into the triggering mechanism;

an air outlet from the triggering mechanism; and a trigger having at least three positions, a first position preventing airflow through the air inlet, a second position allowing air through the inlet and the outlet, and a third position preventing airflow through the outlet;

depressing the trigger from the first to the second position;

placing at least one resin cartridge within the barrel through the first end; and further depressing the trigger to the third position.

9. The method of claim 8 wherein the depressing the trigger to the second position draws a leading end of the piston toward the second end of the barrel and wherein further depressing the trigger to the third position expels the leading end of the piston from the first end of the barrel.

10. The method of claim 8 wherein the depressing the trigger to the second position initiates a venturi effect within the triggering mechanism.

11. The method of claim 8 wherein the depressing the trigger to the third position and expelling of the leading edge of the piston expels the resin cartridge from the piston into the bore hole.

12. The method of claim 8 wherein the at least one resin cartridge comprises two resin cartridges.

* * * * *